US005205236A

United States Patent [19]

Hughes

[11] Patent Number: 5,205,236

[45] Date of Patent: Apr. 27, 1993

[54] STIFFENER CORE FOR A HIGHWAY MARKER

[75] Inventor: Robert K. Hughes, Fort Meyers, Fla.

[73] Assignee: Flexstake, Inc., Ft. Myers, Fla.

[21] Appl. No.: 736,735

[22] Filed: Jul. 26, 1991

[51] Int. Cl.[5] ..... E01F 9/01

[52] U.S. Cl. ..... 116/63 R; 116/209; 404/10; 404/13

[58] Field of Search ..... 116/63 R, DIG. 16, 209, 116/173; 40/608, 610, 612; 404/6, 9, 10, 11, 13

[56] References Cited

U.S. PATENT DOCUMENTS

| | | | |
|---|---|---|---|
| 1,650,093 | 11/1927 | Rank et al. | 116/63 R X |
| 4,270,873 | 6/1981 | Laehy et al. | 40/612 X |
| 4,343,567 | 8/1982 | Sarver et al. | 404/10 |
| 4,373,464 | 2/1983 | Blau | 116/63 R |
| 4,435,930 | 3/1984 | Plym | 404/10 X |
| 4,522,530 | 6/1985 | Arthur | 404/10 |
| 4,621,940 | 11/1986 | Anderson | 404/10 |
| 4,862,823 | 9/1989 | Hughes | 116/209 |
| 4,893,455 | 1/1990 | Hughes | 56/1 |
| 4,939,037 | 7/1990 | Zion et al. | 404/10 X |
| 5,029,783 | 7/1991 | Alvarez | 40/608 X |
| 5,040,478 | 8/1991 | Hughes | 116/209 |

FOREIGN PATENT DOCUMENTS

| | | | |
|---|---|---|---|
| 0113446 | 3/1969 | Denmark | 404/10 |
| 0112804 | 7/1984 | European Pat. Off. | 404/10 |
| 3244858 | 6/1984 | Fed. Rep. of Germany | 404/10 |
| 1540430 | 9/1968 | France | 404/10 |
| 2304722 | 10/1976 | France | 404/10 |

*Primary Examiner*—William A. Cuchlinski, Jr.
*Assistant Examiner*—John L. Beres
*Attorney, Agent, or Firm*—James E. Bradley

[57] ABSTRACT

An impact resistant marker for highway marking has facilities that cause it to deflect if struck by a vehicle. The marker has a base and a post. The post connects to the base by means of a flexible element. The post has a longitudinal hole through it. A stiffener core locates in this hole and extends part of the distance of the hole. The lower end of the stiffener core is spaced above the upper end of the mandrel by a clearance. If struck, the stiffener core causes the post to deflect at the elastomeric element.

4 Claims, 2 Drawing Sheets

STIFFENER CORE FOR A HIGHWAY MARKER

BACKGROUND OF THE INVENTION

1. Field of the invention:

This invention relates in general to highway signs or markers used to mark boundaries of the roadway, and in particular to a marker that is flexible so that it will deflect if struck by a vehicle.

2. Description of the Prior Art:

Highway departments use numerous markers alongside highways to mark the highway. One type of marker is a post that has a reflector mounted to it. Most of these markers are metal. Consequently if a vehicle veers off the road and strikes the post, substantial damage occurs. Also, if the marker is located on the grass area, the mowing of the grass is more difficult. It is time consuming to mow around the various markers.

Recently, flexible posts for markers have been introduced. If struck by a vehicle, the post will deflect. In the type shown in U.S. Pat. No. 4,862,823, an elastomeric sleeve connects the base to the post. The post bends at the elastomeric sleeve to a horizontal position. The post will spring back. This not only avoids damage to the post and vehicle if struck by a vehicle, but also allows a mowing tractor to drive over the post without damage.

While the type shown in the above-mentioned patent is workable, there is a possibility that the post will be damaged if struck by a vehicle traveling at a high enough speed. The flexible element must be fairly stiff to stabilize the post in wind. Also, the post itself is tubular and of a plastic material. Consequently, if a vehicle bumper strikes the post it may damage the post, causing it to bend at a point other than at the flexible element.

SUMMARY OF THE INVENTION

In this invention, the marker has a base and a post connected together by a flexible element. The post has a longitudinal hole extending through it. A stiffener core extends through the hole from the lower end of the post upward. The upper end of the stiffener core terminates below the upper end of the post.

The post has a width greater than its thickness. The hole extending through the post is generally elliptical, having a major diameter greater than a minor diameter. The core also has a width greater than its thickness.

DETAILED DESCRIPTION OF THE INVENTION

Figure 1:
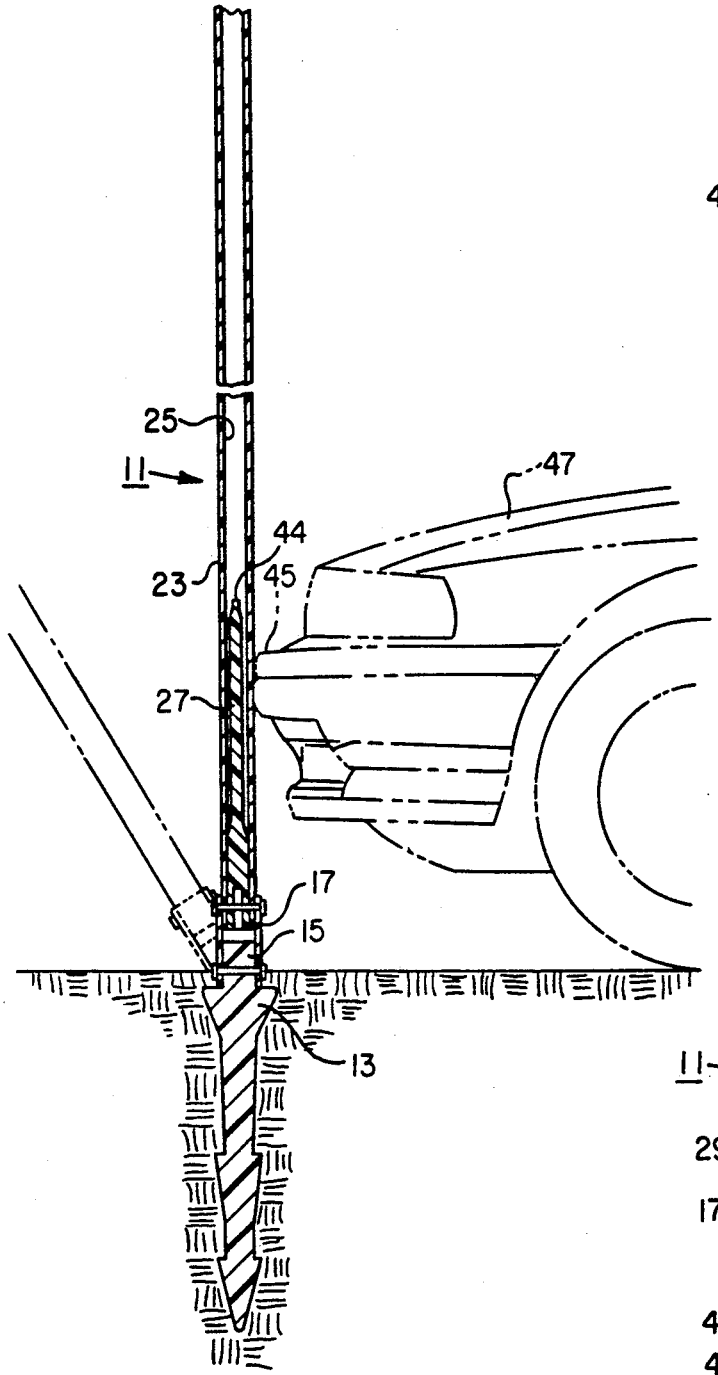
FIG. 1 is a partial sectional view illustrating a marker constructed in accordance with this invention.
Figure 2:
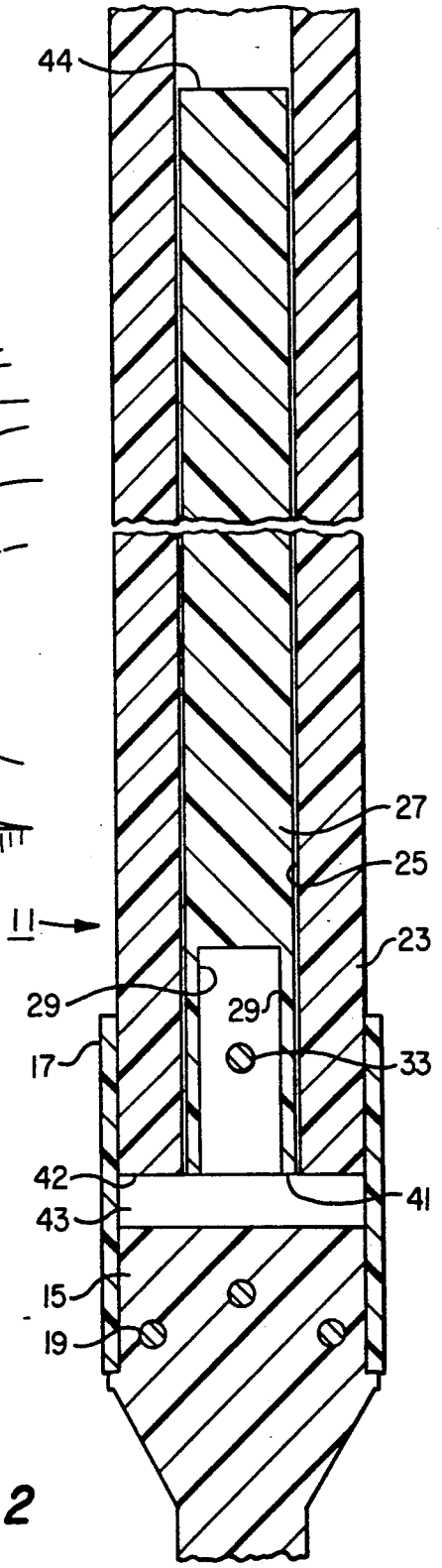
FIG. 2 is an enlarged sectional view of a portion of the marker of FIG. 1, taken along a section line that is ninety degrees from the section of FIG. 1.

Referring to FIG. 1, marker 11 has a base 13. In the embodiment shown, base 13 is an anchor type member that is driven into the ground. Base 13 could also be of a type for securing to asphalt or concrete by adhesive.

Figure 3:
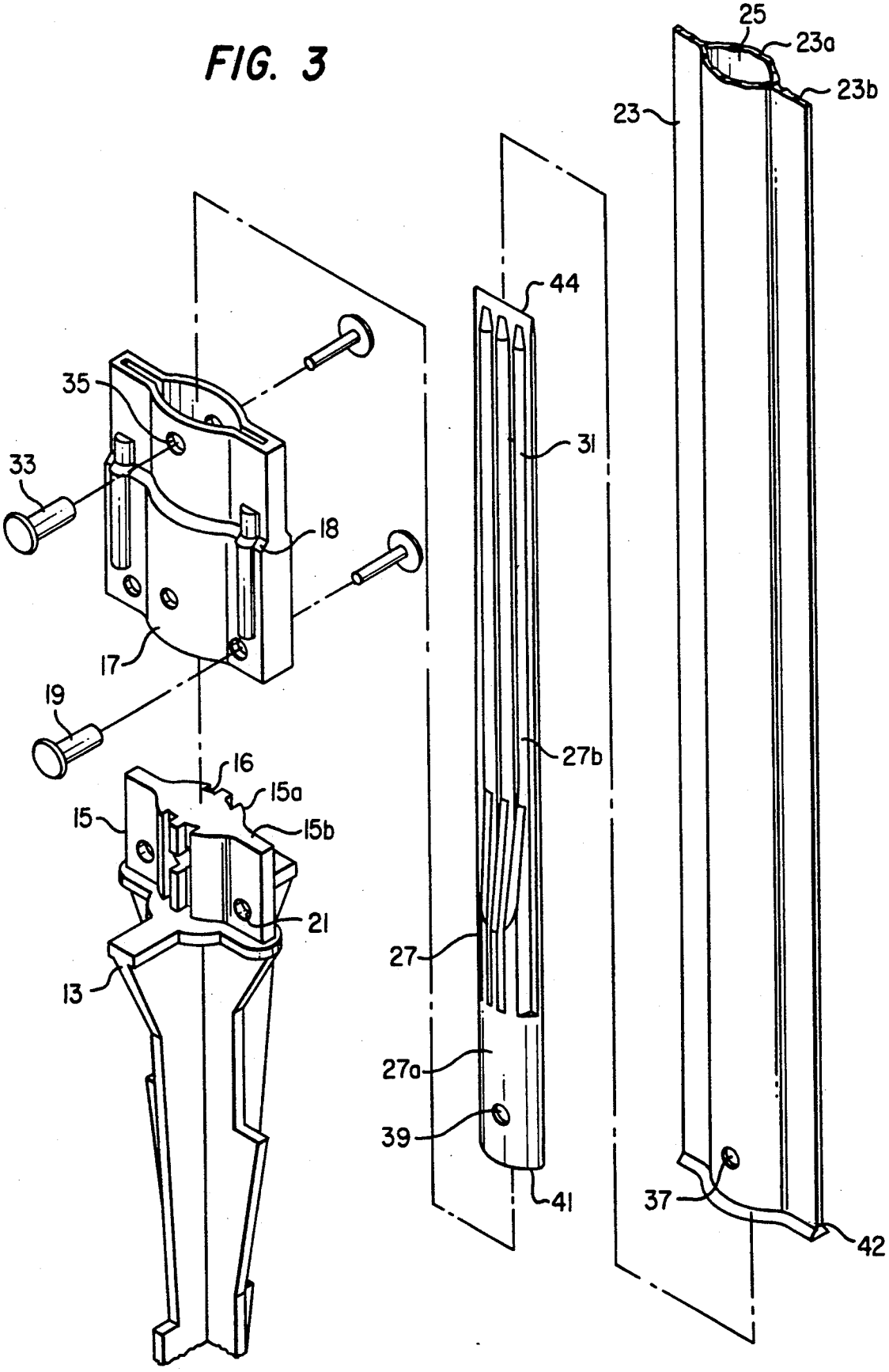
FIG. 3 is a partial exploded perspective view illustrating the marker of FIG. 1.

Base 13 has an upward protruding mandrel 15. As shown in FIG. 3, mandrel 15 has a central portion **15*a* and two side portions 15*b*. The central portion 15*a* is generally elliptical in cross section. The side portions 15*b* are flat and located in a common plane. This results in a greater width of mandrel 15 than its thickness. As used herein, the width means the distance from the side edge of one side portion 15*b* to the side edge of the other portion 15*b*. The thickness is the distance across the central portion 15*a*, measured perpendicular to the width. A plurality of grooves 16 extend longitudinally along the exterior of the central portion 15*a* . Mandrel 15** is solid and of a fairly rigid elastomeric material.

A flexible element 17 has a lower end that slides over the mandrel 15. Flexible element 17 is a flexible elastomeric sleeve that is generally flattened. The major dimension from one side to the other is greater than the minor dimension from front to back. Flexible element 17 has a hole through it that closely receives the mandrel 15 and conforms to the configuration of mandrel 15. The internal dimensions of the hole in flexible element 17 are smaller in the upper portion than in the lower portion, defining a shoulder 18.

Three fasteners 19 extend through holes in the flexible element 17 and holes 21 in the mandrel 15 to secure the flexible element 17 to the mandrel 15. Fasteners 19 are preferably rivets.

A post 23 will secure to the upper end of flexible element 17. Post 23 is of a plastic type material. Post 23 has a central portion **23*a* and two side portions 23*b*. The side portions 23*b* are located in a common plane. The central portion 23*a* has a longitudinal hole 25 that extends through the post 23. Hole 25 is generally elliptical. It has a major diameter which is measured along the plane that contains the side portions 23*b***. It has a minor diameter that is perpendicular to the major diameter. This minor diameter, which would be considered the thickness, is of a lesser dimension than the major diameter.

A stiffener core 27 mounts in the lower portion of the hole 25 extending through post 23. Stiffener core 27 has a lower portion **27*a* and an upper portion 27*b*. The lower portion 27*a* is generally elliptical and closely conforms to the cross section of hole 25. The upper portion 27*b* is solid and flattened. That is, it has the same width as the major diameter of hole 25. However, the thickness is less than the minor diameter of hole 25**.

The lower portion **27*a* has a cavity 29 that extends a short distance upward. A plurality of splines 31 are located on the exterior of the upper portion 27*b*. The stiffener core 27 secures to the post 23 by means of a fastener 33. Fastener 33 extends through a hole 35 in flexible element 17, through a hole 37 in post 23, and through a hole 39 in stiffener core 27**.

When assembled, the lower end 41 of stiffener core 27 will be substantially flush with the lower end of post 23. A flange 42 extends out from the lower end of post 23. During assembly, flexible element 17 slides over the upper end of post 23. The shoulder 18 of flexible element 17 will abut the flange 42. A clearance 43 exists between the upper end of mandrel 15 and the lower end of post 23. The upper end 44 of the stiffener core 27 will be substantially below the upper end of the post 23. Preferably, the stiffener core 27 has a height no greater than about 15–18 inches. This positions the upper end approximately the height of a typical bumper 45 of a vehicle 47 (FIG. 1).

In operation, the marker 11 will be oriented with its width or major dimension facing the point of possible impact. That is, the wider side or front is normal to the direction of flow of traffic. If a bumper 45 of a vehicle 47 strikes the post 23, it will normally strike it at a point below the upper end 44 of stiffener core 27. As a result, the marker 11 will deflect over as shown by the dotted lines in FIG. 1. The marker 11 is capable of deflecting to a completely horizontal position.

The invention has significant advantages. The stiffener core reduces the tendency for the post to bend at the point of impact. This forces the post to bend at the flexible element, instead. This reduces the tendency for the post to weaken or break rather than deflect.

While the invention has been shown in only one of its forms, it should be apparent to those skilled in the art that it is not so limited, but is susceptible to various changes without departing from the scope of the invention.

I claim:

1. An impact resistant marker, comprising in combination:

a base adapted to be secured to the ground and having an upward protruding mandrel;

a post having a longitudinal hole extending therethrough and having a lower end;

an elastomeric flexible element having a lower end secured to the mandrel and an upper end secured to the lower end of the post, so as to allow the post to pivot from an upright position to an inclined position if struck by a vehicle;

a stiffener core extending through the hole in the post from the lower end o the post upward for a selected distance, to cause the post to pivot at the flexible element rather bend above the flexible element, if struck by a vehicle; and wherein the hole is generally elliptical in transverse cross-section, having cross-sectional major and a minor dimensions, and wherein the core has a lower portion that is generally elliptical in transverse cross-section, having substantially the same dimensions as the major and minor dimensions of the hole, the core having an upper portion that has substantially the same major dimension but a lesser minor dimension than the hole.

2. An impact resistant marker, comprising in combination:

a base adapted to be secured to the ground and having an upward protruding mandrel;

a post having a longitudinal hole extending therethrough and having a lower end;

an elastomeric flexible element having a lower end secured to the mandrel and an upper end secured to the lower end of the post, so as to allow the post to pivot from an upright position to an inclined position if struck by a vehicle;

a stiffener core extending through the hole in the post from the lower end of the post upward for a selected distance, to cause the post to pivot at the flexible element rather bend above the flexible element, if struck by a vehicle;

wherein the hole is generally elliptical in transverse cross-section, having cross-sectional major and a minor dimensions, and wherein the core has a lower portion that is generally elliptical in transverse cross-section, having substantially the same dimensions as the major and minor dimensions of the hole, the core having an upper portion that has substantially the same major dimension but a lesser minor dimension than the hole; and wherein the upper portion of the core is solid.

3. An impact resistant marker, comprising in combination:

a base adapted to be secured to the ground;

a mandrel extending upward from the base above the ground, the mandrel having a transverse width and a transverse thickness measured 90 degrees relative to the width, the width being greater than the thickness;

a post having a transverse width and a transverse thickness measured 90 degrees relative to the width, the width being greater than the thickness, the post having a lower end and an upper end;

a longitudinal hole extending through the post;

a tubular elastomeric flexible element having a lower end extending over and being secured to the mandrel and an upper end extending over and being secured to the lower end of the post, the flexible element having a transverse width and a transverse thickness measured 90 degrees relative to the width, the width being greater than the thickness so as to allow the post to pivot from an upright position to an inclined position if the post struck by a vehicle from a direction generally perpendicular to the width of the post;

a stiffener core extending through the hole in the post from the lower end of the post upward, to cause the post to pivot at the flexible element rather than bend above the flexible element if struck by a vehicle;

where the hole has a major dimension that is measured parallel to the width of the post and a minor dimension that is measured parallel to the thickness of the post, and wherein the major dimension is greater than the minor dimension, and wherein the core has a lower portion that has a width substantially the same dimension as the major dimension and a thickness substantially the same dimension as the minor dimension; and wherein the core has an upper portion that has a width substantially the same dimension as the major dimension and has a thickness that is less than the minor dimension.

4. An impact resistant marker, comprising in combination:

a base adapted to be secured to the ground;

a mandrel extending upward from the base above the ground, the mandrel having a transverse width and a transverse thickness measured 90 degrees relative to the width, the width being greater than the thickness;

a post having a transverse width and a transverse thickness measured 90 degrees relative to the width, the width being greater than the thickness, the post having a lower end and an upper end;

a longitudinal hole extending through the post, the hole having a major dimension that is measured parallel to the width of the post and a minor dimension that is measured parallel to the thickness of the post, and wherein the major dimension is greater than the minor dimension;

a tubular elastomeric flexible element having a lower end extending over and being secured to the mandrel and an upper end extending over and being secured to the lower end of the post, the flexible element having a transverse width and a transverse thickness measured 90 degrees relative to the width, the width being greater than the thickness so as to allow the post to pivot from an upright position to an inclined position if the post struck by a vehicle from a direction generally perpendicular to the width of the post;

a stiffener core extending through the hole in the post from the lower end of the post upward to a point below the upper end of the post, to cause the post to pivot at the flexible element rather than bend above the flexible element if struck by a vehicle, the core having a lower portion that has a width substantially the same dimension as the major dimension and a thickness substantially the same dimension as the minor dimension; and wherein the core has an upper portion that has a width substantially the same dimension as the major dimension and has a thickness that is less than the minor dimension.

* * * * *